US008882521B2

(12) United States Patent
Conway et al.

(10) Patent No.: US 8,882,521 B2
(45) Date of Patent: Nov. 11, 2014

(54) LEVER TYPE CONNECTOR WITH ENVIROMENTAL COVER

(71) Applicant: Delphi Technologies, Inc., Troy, MI (US)

(72) Inventors: Michael E. Conway, Youngstown, OH (US); Christopher Adrian Margrave, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 164 days.

(21) Appl. No.: 13/692,301

(22) Filed: Dec. 3, 2012

(65) Prior Publication Data

US 2014/0154910 A1 Jun. 5, 2014

(51) Int. Cl.
*H01R 13/62* (2006.01)
*H01R 13/629* (2006.01)

(52) U.S. Cl.
CPC ..... *H01R 13/62977* (2013.01)
USPC ..... 439/157

(58) Field of Classification Search
USPC ..... 439/358, 157, 152, 160, 266, 372, 149, 439/521, 528, 892; D13/156
See application file for complete search history.

(56) References Cited

U.S. PATENT DOCUMENTS

D296,548 S * 7/1988 Laurie ..... D13/156
D316,399 S * 4/1991 Wharton ..... D13/133
5,681,175 A * 10/1997 Busse et al. ..... 439/157
5,810,612 A 9/1998 Flask et al.
6,168,445 B1 * 1/2001 Seutschniker et al. ..... 439/157
6,213,795 B1 * 4/2001 Drescher et al. ..... 439/157
D448,351 S * 9/2001 Dubosc ..... D13/156
6,305,957 B1 10/2001 Fink et al.
D478,318 S * 8/2003 Burwell et al. ..... D13/146
6,824,406 B1 * 11/2004 Sharples et al. ..... 439/157
7,004,769 B1 * 2/2006 Putnam et al. ..... 439/157
7,094,081 B1 8/2006 Senk et al.
7,241,156 B1 7/2007 Margrave et al.
7,303,415 B2 * 12/2007 Tyler ..... 439/157
7,361,036 B2 * 4/2008 Pittenger et al. ..... 439/157
D602,442 S * 10/2009 Allwood ..... D13/156
8,016,603 B1 * 9/2011 Tsai et al. ..... 439/271
8,197,270 B2 * 6/2012 Vasbinder et al. ..... 439/157
D664,099 S * 7/2012 Fukushima et al. ..... D13/156

* cited by examiner

*Primary Examiner* — Vanessa Girardi
(74) *Attorney, Agent, or Firm* — Thomas N. Twomey

(57) ABSTRACT

An electrical connector assembly for mating with a mating connector includes a housing having spaced apart sidewalls and first and second slides slide slideably supported in the housing. The first and second slides each include at least one mating slot adapted to receive a mating portion of the mating connector and slideable with respect to the housing between a pre-staged position where the electrical connector is removable from the mating connector and an engaged position where said electrical connector assembly is locked to said mating connector. A slide assist lever is pivotally interconnected with the housing and each of the slides to move the slides between the pre-staged position and the engaged position such that recesses are formed in the housing with the slides when said slides are in the engaged position. The electrical connector assembly also includes an environmental cover positionable to substantially prevent debris from entering the recesses.

9 Claims, 4 Drawing Sheets

LEVER TYPE CONNECTOR WITH ENVIROMENTAL COVER

TECHNICAL FIELD OF INVENTION

The present invention relates to an electrical connector assembly and more particularly to an electrical connector assembly having a lever whereby mating and unmating of the connector assembly with a mating connector is effected by movement of a slide assist mechanism caused by rotation of the lever.

BACKGROUND OF INVENTION

Electrical connector assemblies with a lever and slide assist mechanism for mating and unmating with a second connector are known in the art, for example, U.S. Pat. No. 6,305,957 to Fink et al. and U.S. Pat. No. 6,824,406 to Sharples et al. which are both incorporated herein by referent in their entirety. Such connectors typically have a lever that is substantially U-shaped and is pivotally mounted on a housing of the electrical connector assembly. A pair of slide assist mechanisms are also mounted on the housing and slide as a result of pivoting of the lever. The slide assist mechanisms have cam surfaces which engage cam followers on a housing of the second connector. Pivoting of the lever causes the slide assist mechanisms to slide to mate or unmate the electrical connector assembly with the second connector.

In use, the lever is moved to an engaged position in order to mate the electrical connector assembly with the second connector. When the lever is in the engaged position, the slide assist mechanisms are positioned within the housing such that recesses are formed within areas of the housing in which the slide assist mechanisms move. If the electrical connector assembly is used in an environment that may lead to the electrical connector assembly being exposed to dirt or other particulate debris, for example in the undercarriage of an automobile, debris may accumulate in the passages. This accumulation of debris may prevent movement of the slide assist mechanisms when an attempt is made to move the lever out of the engaged position in order to unmate the electrical connector assembly with the second connector.

What is needed is an electrical connector assembly which minimizes or eliminates one or more of the shortcomings as set forth above.

SUMMARY OF THE INVENTION

Briefly described, an electrical connector assembly is provided for mating with a mating connector. The electrical connector assembly includes a housing having spaced apart sidewalls, a first slide slideably supported in the housing and spaced inwardly from one of the sidewalls, and a second slide slideably supported in the housing and spaced inwardly from another of the sidewalls. The first and second slides each include at least one mating slot adapted to receive a mating portion of the mating connector and slideable with respect to the housing between a pre-staged position where the electrical connector is removable from the mating connector and an engaged position where the electrical connector assembly is locked to the mating connector. The electrical connector assembly also includes a slide assist lever pivotally interconnected with the housing and each of the slides and being operable to move the slides between the pre-staged position and the engaged position such that recesses are formed in the housing with the slides when the slides are in the engaged position. The electrical connector assembly also includes an environmental cover positionable to substantially prevent debris from entering the recesses.

BRIEF DESCRIPTION OF DRAWINGS

This invention will be further described with reference to the accompanying drawings in which.

DETAILED DESCRIPTION OF INVENTION

Figure 1:
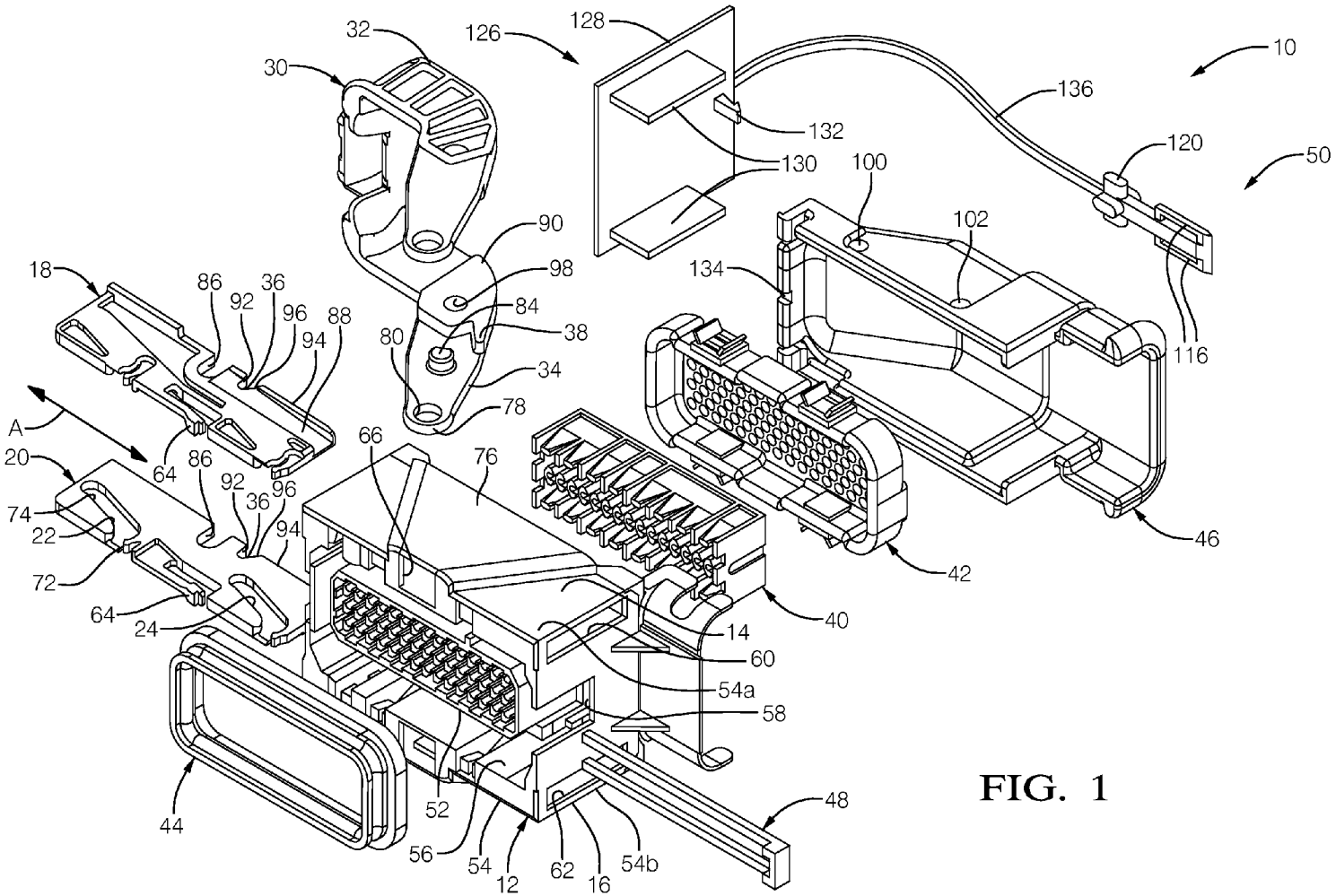
FIG. 1 is an isometric exploded view of an electrical connector assembly in accordance the present invention.

Referring now to FIGS. 1-5 wherein like reference numerals are used to identify identical components in the various views, an electrical connector assembly 10 in accordance with the invention includes a housing 12 having opposing sidewalls 14, 16. First and second slide assist members 18, 20 are slideably supported on opposing sidewalls 14, 16, each slide assist member 18, 20 including at least one mating slot 22, 24 adapted to receive a mating portion 26 of mating connector 28. A slide assist lever 30 is pivotably interconnected with housing 12. Slide assist lever 30 includes a first arm 32 connectable with first slide assist member 18 and a second arm 34 connectable with second slide assist member 20, the slide assist lever 30 being operable to move the slide assist member 18, 20 from a first (pre-staged) location to a second (engaged) location with respect to housing 12 to facilitate mating with mating connector 28. Each slide assist member 18, 20 includes a first notch 36 and each arm 32, 34 includes a slide sensing protrusion 38, each of which mates with first notch 36 when slide assist members 18, 20 are each in the second (engaged) location and slide assist lever 30 is in the second (engaged) position. When slide assist lever 30 becomes disconnected from at least one slide assist member 18, 20 and an attempt to move slide assist lever 30 from the first (pre-staged) position to the second (engaged position) does not correspondingly move the disconnected slide assist member 18, 20 from the first (pre-staged) location to the second (engaged) location, slide sensing protrusion 38 functions to interferingly abut the adjacent disconnected slide assist member 18, 20 thereby preventing slide assist lever 30 from moving to the second (engaged) position.

As shown in FIG. 1, electrical connector assembly 10 includes housing 12, first and second slide assist members 18, 20, slide assist lever 30, a terminal retainer 40, a co-molded cable seal and cable strain relief member 42, a connector seal 44, a wire dress cover 46, a secondary lock member 48, and a connector position assurance (CPA) lock 50. Housing 12 generally includes a terminal area 52 and a first shroud 54 along with a channel 56 formed between terminal area 52 and first shroud 54.

Secondary lock member 48 is received in a secondary lock passage 58 provided in first shroud 54 and cooperates with terminal retainer 40 in a manner described in the previously cited '376 patent to Fink et al. Connector seal 44 is received in channel 56 formed between terminal area 52 and first shroud 54. An upper portion of terminal area 52 includes a second shroud (not shown) for receiving terminal retainer 40 and cable seal and cable strain relief member 42 in a manner described in the previously cited '376 patent to Fink et al.

Housing 12 has left and right passages 60, 62 respectively formed in first and second opposite sides 54*a*, 54*b* of first shroud 54, constructed and arranged so that each of the left and right passages 60, 62 may slideably receive therein the respective slide assist member 18, 20, which are minor images of each other. Each slide assist member 18, 20 is slid into its respective left or right passage 60, 62 and snap fits to prevent backing out via a resilient locking arm 64 which abuttably interacts with a corresponding slot perimeter 66 formed in housing 12. Each side of mating connector 28 includes a protrusion 68. Each protrusion 68 deflects a corresponding locking arm 64 as mating connector 28 is drawn toward electrical connector assembly 10 during mating, thereby enabling each slide assist member 18, 20 to slide within their respective left and right passages 60, 62. Each slide assist member 18, 20 is in the form of an elongated planar body having a pair of like shaped first and second mating slots 22, 24, each having an entry portion 72 and an acutely angled main portion 74, wherein the angular orientations are measured in relation to a slide axis A of slide assist members 18, 20. Each mating slot 22, 24 is constructed and arranged to receive mating portion 26 of the mating connector 28 so as to assist the coupling together of electrical connector assembly 10 and mating connector 28. Mating portion 26 includes a first and a second boss 26*a*, 26*b* (as shown on FIGS. 4 and 5) located on each side of the mating connector 28. Each boss 26*a*, 26*b* is received in a respective mating slot 22, 24.

The outer portion of housing 12 includes a V-shaped pocket 76 formed on the opposite sides 54*a*, 54*b* of the first shroud 54 which respectively communicate with the left and right passages 60, 62. Pockets 76 receive a free end 78 of a respective one of first and second arms 32, 34 of slide assist lever 30. First and second arms 32, 34 of the slide assist lever 30 each have a hole 80 formed therethrough near free end 78 thereof to receive a pivot boss 82 formed on housing 12 inside pocket 76.

Figure 4:
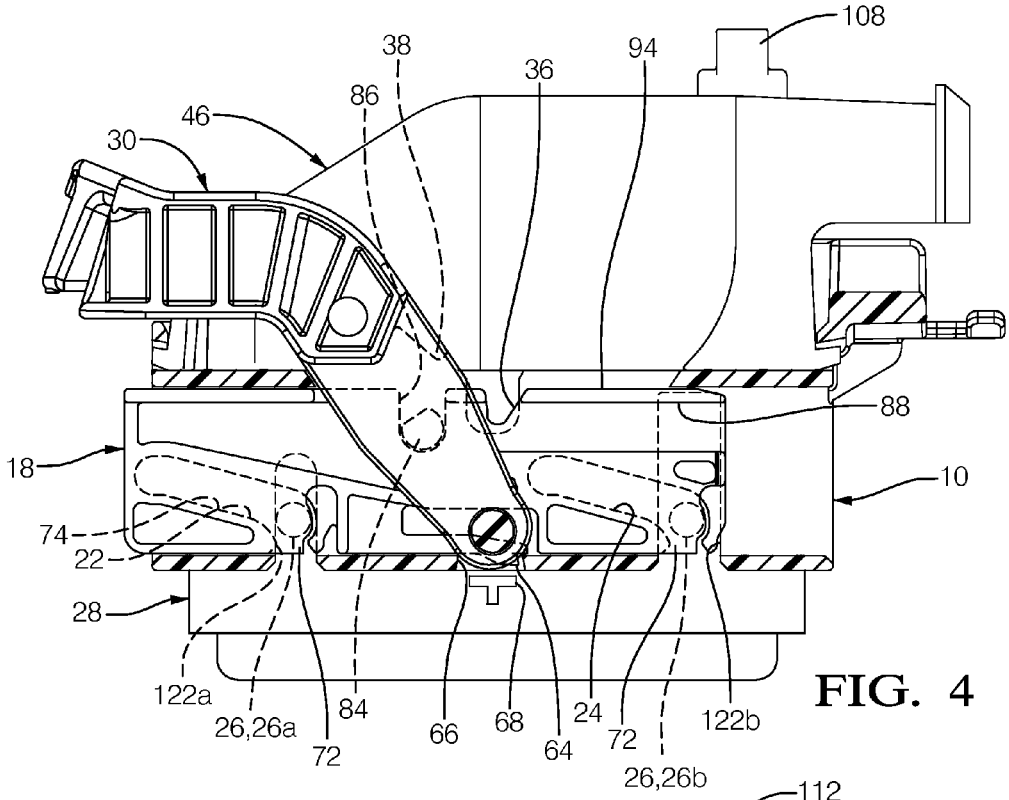
FIG. 4 is a side view of the electrical connector assembly and a mating connector in a first pre-stage position with certain aspects of the electrical connector assembly and the mating connector shown in phantom.
Figure 5:
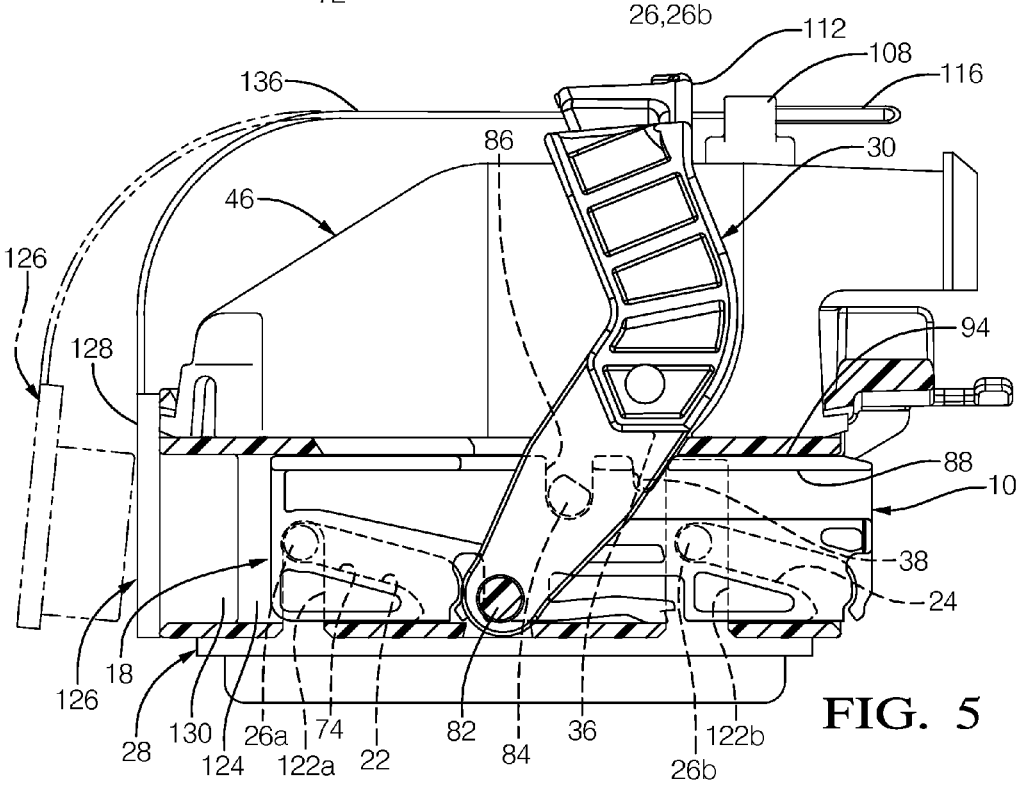
FIG. 5 is a side view of the electrical connector assembly and the mating connector in a second mated position with certain aspects of the electrical connector assembly and the mating connector shown in phantom.

A slide assist push boss 84 is formed on the inside surface of each arm 32, 34 of slide assist lever 30 to be received, respectively, in a concave second notch 86 formed in each slide assist member 18, 20 for moving the slide assist members 18, 20 between the first (pre-staged) location (see FIG. 4) and the second (engaged) location (see FIG. 5).

In order to slidingly place slide assist members 18, 20 into their respective left and right passages 60, 62 with the slide assist lever 30 already mounted on pivot bosses 82, an inclined channel 88 is provided on each the slide assist members 18, 20 so as to slidably engage slide assist push boss 84 and allow it to enter second notch 86 without interference in the increasing inclination direction, as shown. Inclined channel 88 extends parallel with respect to the slide axis A.

An anti-rotation pad 90 is formed on the inside surface of each arm 32, 34 of slide assist lever 30. Each anti-rotation pad 90 includes slide sensing protrusion 38 to be received, respectively, in first notch 36 formed in each slide assist member 18, 20 when the slide assist lever 30 is in the second (engaged) position and both slide assist members 18, 20 are in the second (engaged) location. Each slide sensing protrusion 38 generally has a V-shape extending along each arm 32, 34 with the tip of the "V" pointing generally toward the location (generally shown at 80) where slide assist lever 30 pivotally connects with housing 12. First notch 36 generally has a slanted V-shape, the "V" being slanted with respect to slide axis A. First notch 36 includes a first side 92 extending perpendicularly with respect to a top surface 94 (as viewed in FIGS. 2 through 5) and a second side 96 extending obliquely with respect to the top surface 94. First notch 36 is oriented such that second side 96 extends upwardly and slants toward the direction slide assist member 18, 20 slides as it moves from the first (pre-staged) location to the second (engaged) location. Second side 96 provides clearance for slide sensing protrusion 38 to be received into first notch 36 as arms 32, 34 rotate and slide assist members 18, 20 slide. Each anti-rotation pad 90 also functions to stiffen each arm 32 to reduce bowing that causes arms 32, 34 to spread apart and disengage from slide assist members 18, 20.

Wire dress cover 46 and slide assist lever 30 include mutually engaging locking elements for retaining the slide assist lever 30 in each of the first and second positions. In this regard, an aperture 98 is provided on each of the arms 32, 34 of slide assist lever 30 for engagement with first and second nubs 100, 102 formed in wire dress cover 46 (see FIG. 2) so as to lightly retain slide assist lever 30 at the first (pre-staged) position, as shown at FIG. 4 and at the second (engaged) position, as shown at FIG. 5.

Figure 2:
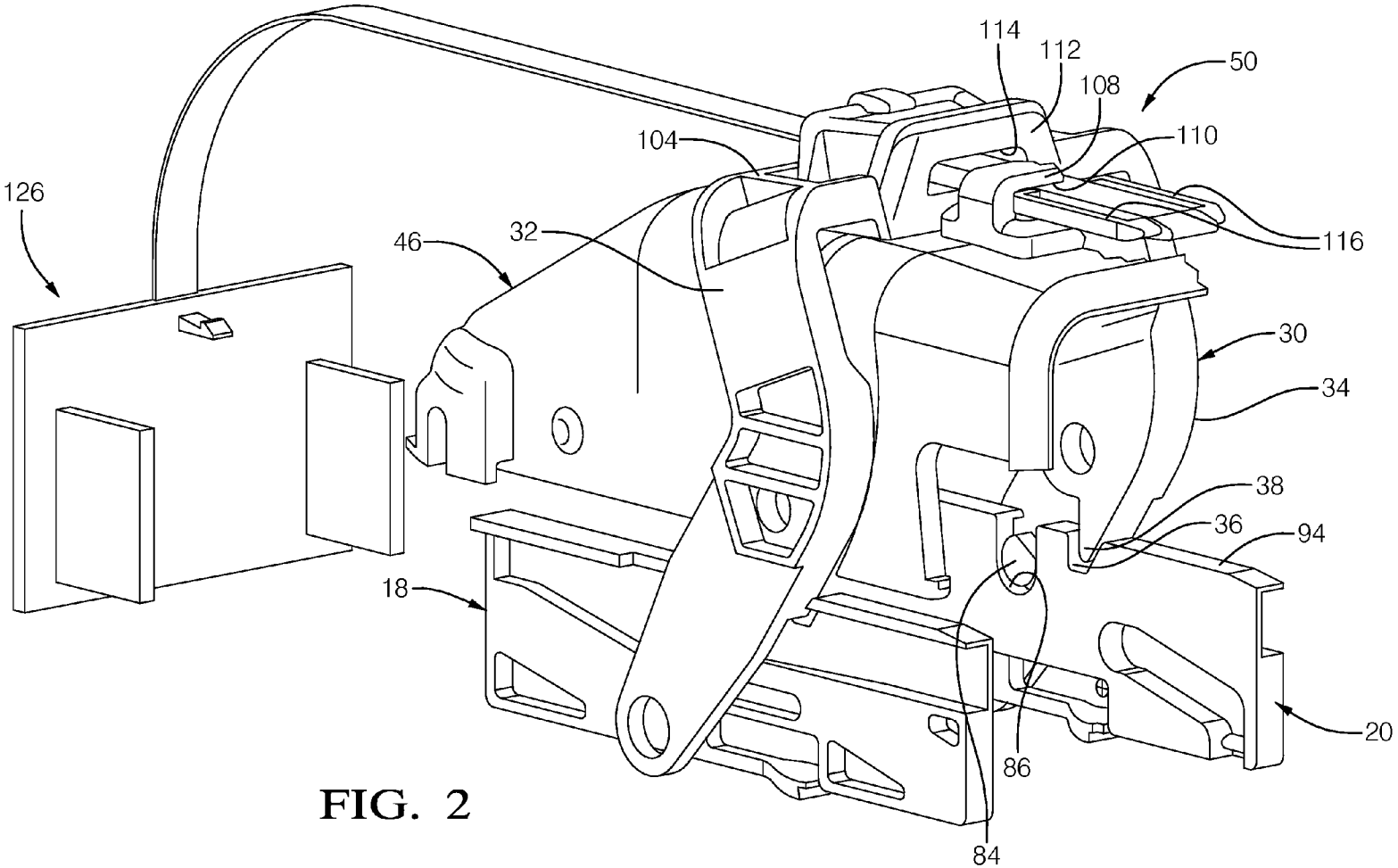
FIG. 2 is an isometric view of a first aspect of the electrical connector assembly.

As shown at FIG. 2, in order to firmly retain slide assist lever 30 at the second (engaged) position, a bar 104 which connects first and second arms 32, 34 engages a resiliently mounted boss (not shown) of wire dress cover 46. The previously cited '376 patent to Fink et al. further describes and illustrates these features.

As shown in FIGS. 1 and 2, electrical connector assembly 10 includes connector position assurance (CPA) lock 50. In this regard, wire dress cover 46 includes a CPA lock feature 108 having a first cavity 110 and bar 104 of the slide assist lever 30 includes a CPA alignment feature 112 having a second cavity 114. Connector position assurance lock 50 includes two flexible lock arms 116 and a lock tab 120. Connector position assurance lock 50 is installed when slide assist lever 30 is at the second (engaged) position. When slide assist lever 30 is at the second (engaged) position, first cavity 110 and second cavity 114 align, thereby enabling connector position assurance lock 50 to be inserted through each first and second cavities 110, 114. During installation of connector position assurance lock 50, flexible lock arms 116 are inserted through first and second cavities 110, 114. After installation, connector position assurance lock 50 is held in place by engagement of the flexible lock arms 116 with CPA lock feature 108 on the wire dress cover 46 and engagement of lock tab 120 with CPA alignment feature 112 on slide assist lever 30. Once electrical connector assembly 10 and mating connector 28 are completely engaged and connector position assurance lock 50 is slid into position, electrical connector assembly 10 and mating connector 28 are locked in place and cannot be disengaged until connector position assurance lock 50 is removed.

FIG. 2 illustrates first and second slide assist members 18, 20, slide assist lever 30, wire dress cover 46, and connector position assurance lock 50 when electrical connector assembly 10 is in an engaged position. Each slide assist push boss 84 is received in the respective second notch 86. Each slide sensing protrusion 38 is received in the respective first notch 36. Connector position assurance lock 50 is held in place by engagement of flexible lock arms 116 with CPA lock feature 108 on wire dress cover 46 and engagement of lock tab 120 with CPA alignment feature 112 on slide assist lever 30.

Figure 3:
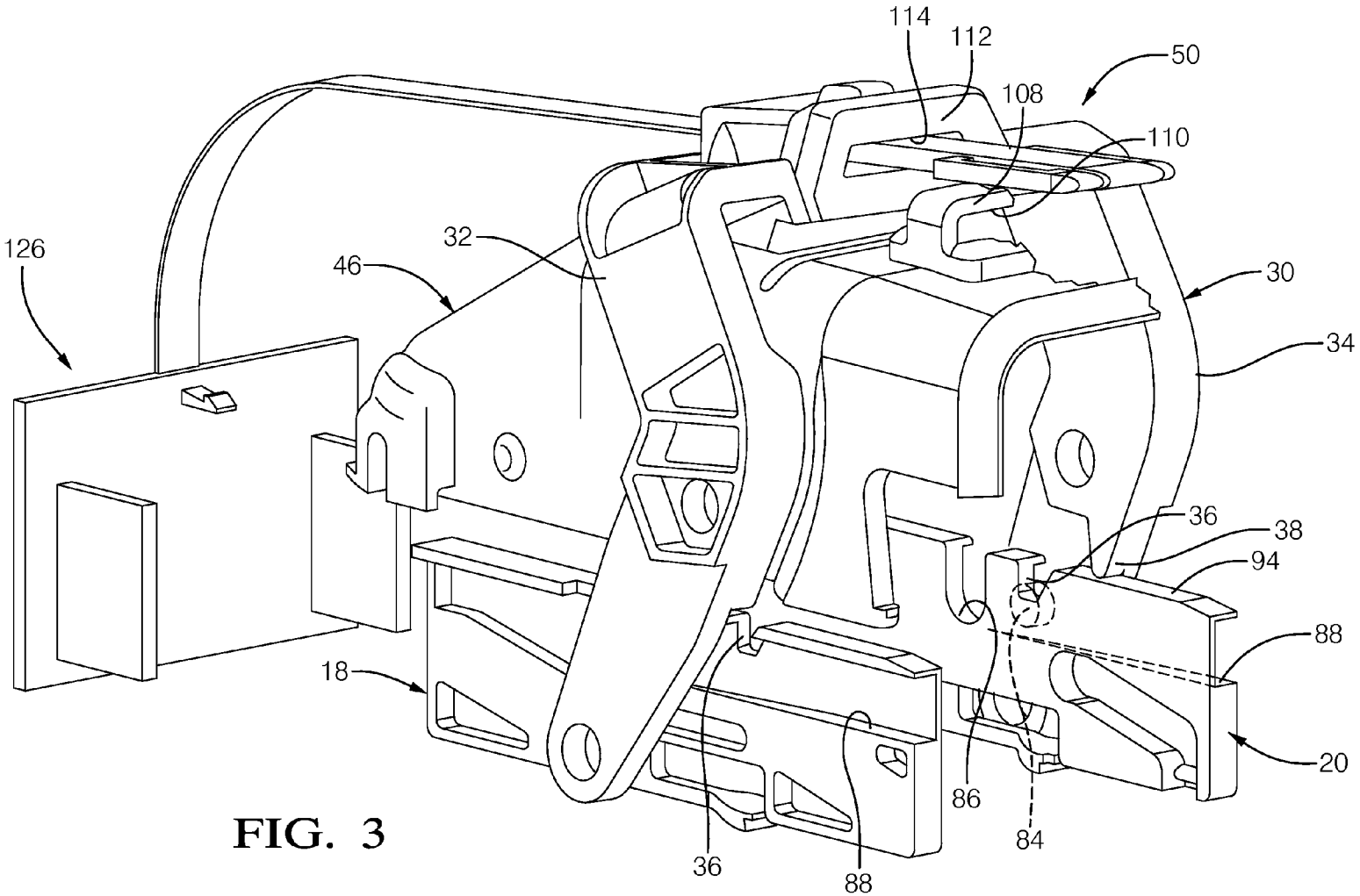
FIG. 3 is an isometric view of a second aspect of the electrical connector assembly.

FIG. 3 illustrates first and second slide assist members 18, 20, slide assist lever 30, wire dress cover 46, and connector position assurance lock 50 after an attempt has been made to move slide assist lever 30 to second (engaged) position and slide assist push boss 84 on one of lever arms 32, 34 (second arm 34 in this example) has disengaged from second notch 86 of the adjacent slide assist member 20. In this state, slide assist push boss 84 of second arm 34 is disengaged from second notch 86 and slide sensing protrusion 38 of second arm 34 abuts top surface 94 of slide assist member 20. First cavity 110 does not align with second cavity 114. Consequently, connector position assurance lock 50 cannot engage with both CPA alignment feature 112 on the slide assist lever 30 and CPA lock feature 108 on wire dress cover 46. As shown in phantom, slide assist push boss 84 is positioned along and captured by inclined channel 88.

The abutment of slide sensing protrusion 38 with top surface 94 of the slide assist member 18, 20 prevents movement of slide assist lever 30 to the second (engaged) position when at least one of slide assist members 18, 20 does not correspondingly move to the second (engaged) location. As a result, an operator immediately receives feedback that electrical connector assembly 10 and mating connector 28 have not properly mated. The operator can then reattach slide assist lever 30 to disengaged slide assist member 18, 20 by moving slide assist lever 30 back to the first (pre-staged) position. During this movement, slide assist push boss 84 follows inclined channel 88 to reengage second notch 86.

Referring now to FIGS. 4 and 5, the operation of the slide assist system of electrical connector assembly 10 will now be described. The previously cited '376 patent to Fink et al. and the previously cited '406 patent to Sharples et al. provide additional description of details of the operation that may not be described herein. As indicated earlier with reference to FIG. 1, slide assist members 18, 20 each have mating slots 22, 24 having entry portion 72 and main portion 74, wherein the angular orientation, as mentioned, is defined by the slide axis A of slide assist members 18, 20. FIG. 4 shows slide assist lever 30 at the first (pre-staged) position. Entry portion 72 of each mating slot 22, 24 is aligned with a respective primary slot 122*a*, 122*b* formed in first shroud 54 of housing 12. Each primary slot 122*a*, 122*b* is constructed and arranged so that a respective boss 26*a*, 26*b* on mating connector 28 is received thereinto as the mating connector 28 is seated into electrical connector assembly 10.

Continuing to refer to FIG. 4, a first (pre-stage) position of the electrical connector assembly 10 with respect to mating connector 28 is shown, wherein mating connector 28 is intermediately seated into housing 12 via channel 56 (not shown on FIG. 4). Each boss 26*a*, 26*b* has passed through the respective primary slot 122*a*, 122*b*, entered into entry portion 72 of mating slot 22, 24 and is now stopped at main portion 74. From the first (pre-stage) position, slide assist lever 30 may be pivoted to actuate the slide assist system to thereby further seat mating connector 28 into electrical connector assembly 10 (any further need for manual pressing of mating connector 28 into electrical connector assembly 10 being obviated).

Referring now to FIG. 5, a second (mated) position of electrical connector assembly 10 with respect to the mating connector 28 is shown. Slide assist lever 30 is shown at the second (engaged) position, whereupon the boss (not shown) of the wire dress cover 46 is snapped onto bar 104 of the slide assist lever 30 and mating connector 28 is fully seated with electrical connector assembly 10. At this position, the male and female terminals (not shown) are properly electrically engaged with each other. Each boss 26*a*, 26*b* is fully received in the respective mating slot 22, 24. Each slide sensing protrusion 38 is received within respective first notch 36. Connector position assurance lock 50 is held in place by engagement of the flexible lock arms 116 with the CPA lock feature 108 on wire dress cover 46 and engagement of lock tab 120 with the CPA alignment feature 112 on slide assist lever 30.

As can be seen in FIG. 5, a recess 124 is formed in housing 12 with slide assist member 18 when slide assist members 18, 20 are in the second (engaged) position. It should be noted that only one recess 124 associated with first slide assist member 18 is shown in FIG. 5, but a corresponding recess 124 associated with second slide assist member 20 is similarly formed. An environmental cover 126 is provided and is positionable to substantially prevent debris, such as dirt, from entering recesses 124 during use of electrical connector assembly 10. An accumulation of debris in recesses 124 may prevent slide assist members 18, 20 from moving to the pre-staged (first) position when it is desired to remove electrical connector assembly 10 from mating connector 28. Environmental cover 126 includes plate 128 which abuts housing 12 to cover recesses 124 when environmental cover 126 is positioned to substantially prevent debris from entering recesses 124. Environmental cover 126 also includes tenons 130 which extend from plate 128 and which extend into recesses 124 when environmental cover 126 is positioned to substantially prevent debris from entering recesses 124. Tenons 130 are configured to fit closely within recesses 124. Environmental cover 126 is provided with a flexible retaining latch 132 which is mateable with a corresponding notch 134 in wire dress cover 46 in order to retain environmental cover 126 over recesses 124 when environmental cover 126 is positioned to substantially prevent debris from entering recesses 124. One end of a flexible tether 136 is attached to environmental cover 126 while the other end of tether 136 is attached to connector position assurance lock 50. Connector position assurance lock 50, environmental cover 126, and tether 136 are preferably integrally molded as a single piece of plastic, for example, in an injection molding operation. FIG. 5 illustrates environmental cover 126 in phantom lines in an uninstalled position and in solid lines in an installed position.

While this invention has been described in terms of preferred embodiments thereof, it is not intended to be so limited, but rather only to the extent set forth in the claims that follow.

We claim:

1. An electrical connector assembly for mating with a mating connector, said electrical connector assembly comprising:

a housing having spaced apart sidewalls;

a first slide slideably supported in said housing and spaced inwardly from one of said sidewalls;

a second slide slideably supported in said housing and spaced inwardly from another of said sidewalls;

said first slide and said second slide each including at least one mating slot adapted to receive a mating portion of said mating connector and slideable with respect to said housing between a pre-staged position where said electrical connector assembly is removable from said mating connector and an engaged position where said electrical connector assembly is locked to said mating connector;

a slide assist lever pivotally interconnected with said housing and each of said slides and being operable to move said slides between said pre-staged position and said engaged position, wherein recesses are formed in said housing with said slides when said slides are in said engaged position; and an environmental cover positionable to substantially prevent debris from entering said recesses.

2. An electrical connector assembly as in claim 1, wherein said environmental cover includes a plate abutting said housing and covering said recesses when said environmental cover is positioned to substantially prevent debris from entering said recesses.

3. An electrical connector assembly as in claim 1, wherein said environmental cover includes a pair of tenons extending into said recesses when said environmental cover is positioned to substantially prevent debris from entering said recesses.

4. An electrical connector assembly as in claim 1, wherein said environmental cover includes a flexible retaining latch which is mateable with a corresponding notch that is fixed relative to said housing, said flexible retaining latch together with said notch retaining said environmental cover over said recesses when said flexible retaining latch is mated with said corresponding notch.

5. An electrical connector assembly as in claim 1, wherein a flexible tether is attached to said environmental cover at one end of said flexible tether and the other end of said flexible tether includes a connector position assurance lock that is engageable with said slide assist lever when said slide assist lever is in said engaged position to prevent said slide assist lever from moving out of said engaged position when said connector position assurance lock is engaged with said slide assist lever.

6. An electrical connector assembly for mating with a mating connector, said electrical connector assembly comprising:

a housing having spaced apart sidewalls;

a first slide slideably supported in said housing and spaced inwardly from one of said sidewalls;

a second slide slideably supported in said housing and spaced inwardly from another of said sidewalls;

said first slide and said second slide each including at least one mating slot adapted to receive a mating portion of said mating connector and slideable with respect to said housing between a pre-staged position where said electrical connector assembly is removable from said mating connector and an engaged position where said electrical connector assembly is locked to said mating connector;

a slide assist lever pivotally interconnected with said housing and each of said slides and being operable to move said slides between said pre-staged position and said engaged position, wherein recesses are formed in said housing with said slides when said slides are in said engaged position; and an environmental cover positionable to substantially prevent debris from entering said recesses, said environmental cover including a plate abutting said housing and coving said recesses when said environmental cover is positioned to substantially prevent debris from entering said recesses.

7. An electrical connector assembly as in claim 6, wherein said environmental cover includes a pair of tenons extending from said plate into said recesses when said environmental cover is positioned to substantially prevent debris from entering said recesses.

8. An electrical connector assembly as in claim 6, wherein said environmental cover includes a flexible retaining latch which is mateable with a corresponding notch that is fixed relative to said housing, said flexible retaining latch together with said notch retaining said environmental cover over said recesses when said flexible retaining latch is mated with said corresponding notch.

9. An electrical connector assembly as in claim 6, wherein a flexible tether is attached to said environmental cover at one end of said flexible tether and the other end of said flexible tether includes a connector position assurance lock that is engageable with said slide assist lever when said slide assist lever is in said engaged position to prevent said slide assist lever from moving out of said engaged position when said connector position assurance lock is engaged with said slide assist lever.

* * * * *